United States Patent [19]

Tölle

[11] 4,344,375

[45] Aug. 17, 1982

[54] SEWING MACHINE WITH A LOOPER ARRANGED ABOVE THE POINT OF STITCH FORMATION

[75] Inventor: Günter Tölle, Bruchsal, Fed. Rep. of Germany

[73] Assignee: Pfaff Industriemaschinen GmbH, Fed. Rep. of Germany

[21] Appl. No.: 846,989

[22] Filed: Oct. 31, 1977

[30] Foreign Application Priority Data

Nov. 3, 1976 [DE] Fed. Rep. of Germany ..... 2650352

[51] Int. Cl.[3] ..... D05B 57/14; D05B 57/26; D05B 29/06; D05B 3/06

[52] U.S. Cl. ..... 112/131; 112/70; 112/231; 112/235

[58] Field of Search ..... 112/181, 183, 235, 236, 112/231, 70

[56] References Cited

U.S. PATENT DOCUMENTS

| | | | |
|---|---|---|---|
| 2,419,698 | 4/1947 | Wood | 112/231 |
| 2,824,938 | 7/1974 | Tölle | 112/70 |
| 3,054,369 | 9/1962 | Adam | 112/231 |

FOREIGN PATENT DOCUMENTS

| | | | |
|---|---|---|---|
| 372908 | 12/1963 | Switzerland | 112/236 |
| 20214 | of 1893 | United Kingdom | 112/181 |
| 282911 | 1/1971 | U.S.S.R. | 112/231 |

*Primary Examiner*—W. Carter Reynolds
*Attorney, Agent, or Firm*—McGlew and Tuttle

[57] ABSTRACT

A sewing machine for sewing workpieces, comprises a stationary bottom part with an arm which has one end pivotally mounted on the bottom part and an opposite end overlying the bottom part. The arm is movable from a fixed sewing position to an inoperable position away from the point of stitch formation. A revolving looper is mounted on the end of the opposite arm and it has a thread exit opening and a needle is mounted for upward and downward movement in the bottom part for cooperation with the looper. The workpiece is clamped between the base part and the arm and the needle traverses the workpiece upwardly. The construction includes a looper thread guide member mounted on the opposite arm adjacent the looper and has a thread deflector located between the needle path and the thread exit opening of the looper and extending above the point of stitch formation directly laterally of the needle path crosswise to the axis of the looper.

2 Claims, 3 Drawing Figures

SEWING MACHINE WITH A LOOPER ARRANGED ABOVE THE POINT OF STITCH FORMATION

FIELD AND BACKGROUND OF THE INVENTION

This invention relates to sewing machines in general and, in particular, to a new and useful sewing machine having a stationary bottom part, an arm pivotally mounted on the bottom part and movable from a fixable sewing position to an inoperative position away from the point of stitch formation, and a revolving looper which is received by the arm and cooperates with a needle guided in the bottom part and traverses the work upwardly, and which also includes a displaceable work clamp with a tensioning frame for the work.

DESCRIPTION OF THE PRIOR ART

For the execution of certain sewing jobs, the use of sewing machines where the looper is arranged above the work-bearing surface and the needle passes through the work upwardly is known. In this type of machine, the looper thread runs from the exit hole in the bobbin capsule disposed laterally of the plane in which the looper tip revolves obliquely to the point of insertion in the work. This oblique position leads to different stitch pull-in relations at different transport directions of the work relative to the looper axis. When making button holes, particularly where the two beaded seams are made in opposite feed directions, the different stitch pull-in force becomes evident, due to the stitches lying close together, in an irregular appearance of the two beaded seams.

SUMMARY OF THE INVENTION

The present invention provides a sewing machine with a looper arranged above the work and includes a thread conduction which ensures feed of the looper thread to the point of stitch formation, largely independent of the transport direction of the work.

In accordance with the invention, a looper thread guide member is secured on the arm of the sewing machine and it comprises a thread deflector situated between the needle path and the exit opening for the looper thread and extending above the point of stitch formation directly lateral of the needle path crosswise to the axis of the looper. With this arrangement, the looper thread runs almost perpendicularly from the deflection point to the stitch formation point. When the feed is changed, this results in insignificant deviations of the forces when the looper thread is being pulled through the loop of the needle thread, so that the stitch pull-in is sufficiently compensated and, hence, uniform appearance of the two beaded seams of a buttonhole stitch is obtained.

The proposed solution offers the possibility of designing the guide member so that the stitch formation is further improved, particularly when sewing very thin fabrics. To this end, the guide member is connected with a work hold-down member which is directed downwardly from the thread deflector, and which, in the area of the stitch formation point, protrudes between the lateral bearing parts of the tensioning frame to directly above the contact plane of the tensioning frame on the work. By this measure, the flapping of the work upon insertion of the needle is avoided to a large extent and the stitch formation is thereby improved.

At the same time, the guide member is advantageously designed as a stopping element for the bobbin capsule. In addition to favorable production by simplified handling, this results in reduced space requirement at the machine.

Accordingly, it is an object of the invention to provide a sewing machine which includes a bottom part containing a reciprocating needle and an arm pivoted on the bottom part which contains a rotatable looper having a thread guide deflector associated therewith between the needle path and the thread exit opening of the looper located above a point of stitch formation directly laterally of the needle path and crosswise to the axis of the looper.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
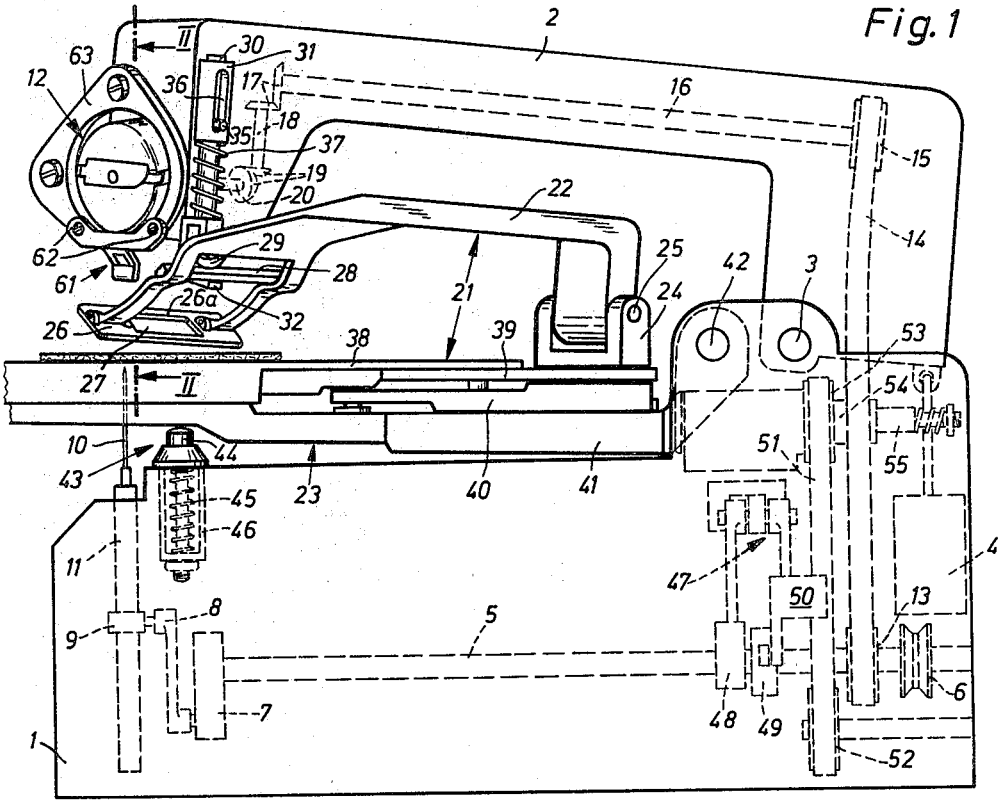
FIG. 1 is a side elevational view of a sewing machine constructed in accordance with the invention.

Referring to the drawing in particular, the invention embodied therein, comprises a sewing machine for sewing workpieces which includes a bottom part or stationary part 1 which forms a base for a pivotal arm or upper part 2 which is pivoted on the bottom part on a pivot 3 at one end of the arm part 2. In accordance with the invention, the needle 10 is arranged in the bottom part for upward and downward reciprocation in cooperation with a revolving looper 12 which is arranged on the outer end of the arm 2. This outer or opposite end of arm 2 is positioned overlying the bottom part.

There is shown in the drawing, as an embodiment of the invention, a stitch-group sewing machine, designed as a buttonhole machine, which comprises a stationary bottom part or frame 1 and an arm 2 articulated thereto which is mounted on a pivot or pin 3 secured in the bottom part 1. In order to move arm 2 from the sewing position into its inoperative position, away from the stitch formation point, arm 2 is connected laterally of pin 3 with an armature of a bilaterally acting electromagnet 4 which is fixed in its two end positions, so that both the sewing position and the inoperative position of arm 2 is thereby determined. It is also possible to fix the arm additionally in its two positions with the use of appropriate stops.

A main shaft 5, carrying a belt wheel or pulley 6 and driven by a stopping motor, which has not been shown, is mounted in the bottom part 1 of the sewing machine. A crank 7 is arranged at the free end of the main shaft 5. Through a link 8 and an intermediate member 9, the crank drives a needle-bar 11, carrying a thread-guiding needle 10. Needle 10 thus punctures the work upwardly and cooperates with a revolving looper 12 which is mounted on the end face of arm 2.

For the drive of looper 12, a belt wheel or pulley 13 is secured on the main shaft 5, which drives a shaft 16 mounted in arm 2 through a toothed belt 14 and a counterwheel or pulley 15 which, in turn, imparts a rotary movement to a vertically disposed shaft 18 through a bevel gear pair 17. Through another bevel gear pair 19, shaft 18 is in drive connection with the shaft 20 of looper 12, which is thus driven through the described gear train in the ratio 2:1 to the needle movement.

The sewing machine illustrated in the embodiment of the invention comprises a work clamp 21 which is essentially formed by an upper part 22 and a lower or bottom part 23. The upper clamp part 22 comprises an arm having one end which is received by a bearing block 24 secured to the lower part 23 and it is pivotable about a horizontal axis 25 extending obliquely to the main shaft 5 of the machine. The arm of clamp part 22 includes an opposite end overlying the lower part 23. A tensioning frame 26 is mounted in a manner known per se at the front end of the upper clamp part 22 and presses the work against the lower clamp part 23. The frame 26 includes a cutout 27, limited by a lateral bearing part 26*a* for the passage of needle 10 and a buttonhole knife, not shown.

The front end or front arm portion of the upper clamp part 22 is further provided with a pressure bar 28 extending parallel to the direction of feed of the work, on which a pressure roller 29 rolls. Pressure roller 29 is mounted freely rotatable at the lower end of a guide rod 30, there designed in fork form, which is displaceably received within a cast-on part 31 of arm 2. At its lower end, the guide rod 30 is equipped with a tappet 32 which engages the pressure bar 28 from below.

Guide rod 30 carries a pin 35 set perpendicular to its longitudinal axis, which glides within a slot 36 in the cast-on part 31 extending parallel to its longitudinal axis and which limits the longitudinal mobility of the guide rod 30. A spring 37, placed between part 31 and the lower end of guide rod 30, holds the upper clamp part 22 always in its low position.

The lower clamp part 23 is formed by a cover plate 38, an actual work-carrying plate 39, an intermediate plate 40 and a baseplate 41. The baseplate 41 is pivotally mounted by means of a pin or pivot 42 at bottom part 1 and is supported in the region of the stitch formation point against a seat 43 which is displaceably disposed in the bottom part 1. Seat 43 is formed by a bolt 44 which is displaceably mounted within a guide bushing 46, secured on the bottom part 1, and is urged upwardly by a spring 45. The characteristic of spring 45 is steeper than that of spring 37. A nut at the lower end of bolt 44 limits the mobility of bolt 44 in an upward direction.

A stepping mechanism 47 is provided in the bottom part 1 and it comprises two eccentrics 48 and 49 on the lower main shaft 5, which impart a feed movement to a belt tool 50, as well as a spreading or clamping movement, whereby, the movement derived from the eccentric 48 is transmitted to a toothed belt 51. Toothed belt 51 is passed over a guide wheel 52 mounted in bottom part 1 and a belt wheel 53 is secured on a threaded nut 54. The threaded nut 54 is mounted rotatably, but nondisplaceably, in an axial direction in the bottom part 1. A threaded spindle 55 is screwed into the threaded nut 54 and is moved back and forth according to the direction of rotation of threaded nut 54. Threaded spindle 55 is connected with intermediate plate 40 and serves to shift the tensioning frame 26, as well as the work-carrying plate 39 and the cover plate 38 secured thereon.

The mechanism provided for this purpose is described in detail in U.S. Pat. No. 3,824,938. For comprehension of the invention, it is sufficient to know that upon driving the threaded spindle 53 in one direction or the other, the tensioning frame 26, together with the work-carrying plate 39 and the cover plate 38, move forward and back in the longitudinal direction of the tensioning frame 26.

Figure 2:
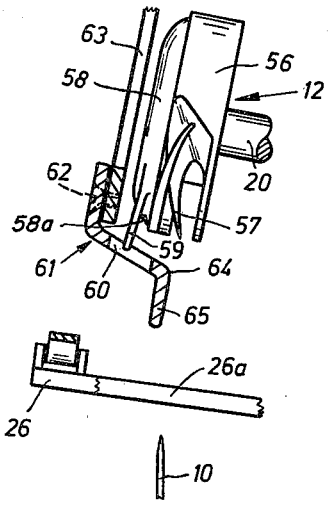
FIG. 2 is a partial sectional view taken along the line II—II of FIG. 1.
Figure 3:
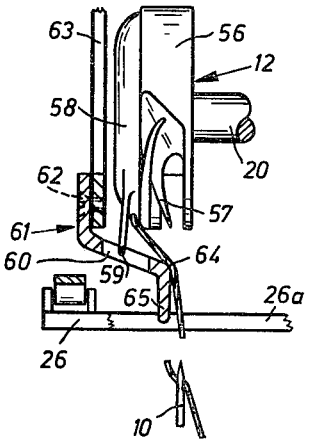
FIG. 3 is a section, similar to FIG. 2, showing the parts in an advanced position of operation.

Looper 12 (FIGS. 2 and 3) comprises, in a known manner, a looper body or housing 56, with a looper tip 57 seizing the needle thread loop, and includes a bobbin capsule 58 which does not take part in the rotary movement of looper body 56. The guide member 61 is secured to a holder 63, which is secured to arm 2, by means of two screws 62. Guide member 61 is extended beyond the recess 60 and presents a thread deflector or deflection edge 64 which is situated in the sewing position of arm 2 between the needle path and the exit opening 58*a* of the looper thread in the bobbin capsule 58, and which extends above the stitch formation point directly next to or lateral of the needle path crosswise to the axis of looper 12. The length of this thread deflector 64 corresponds at least approximately to the width of the cutout 27 in the tensioning frame 26.

Starting from the thread deflector 64, the guide member 61 is bent downwardly and forms a fabric hold-down member 65 which, in the sewing position of arm 2, protrudes between the lateral bearing parts 26*a* of frame 26 and terminates directly above the bearing plane of frame 26 in the region of the stitch formation point. This region means the immediate lateral surrounding of the stitch formation point. Depending on the type of sewing operations to be executed on the sewing machine, fabric hold-down member 65 may be designed differently. For the design described, intended for buttonhole sewing, the design extending transverse to the longitudinal direction of the tensioning frame 26, as illustrated, is sufficient. Alternatively, the hold-down 65 may surround the stitch formation point annularly.

The operation of the sewing machine is as follows:

It is assumed that arm 2 occupies its inoperative position away from the stitch formation point and the work is placed on the cover plate of the lower clamp part 23. As the tensioning frame 26 of upper clamp part 22 is lifted off lower clamp part 23 by only a small amount, insertion and especially aligning of the work, is comparatively simple.

During insertion, the lower clamp part 23 occupies an almost horizontal position, with the baseplate 41 resting on the seat 43 formed by the bolt 44 and spring 45 being practically relaxed in the guide bushing 46. The tappet 32 provided at the lower end of the guide rod 30 engages the pressure bar 28 from below and pin 35 makes contact at the lower end of the slot 36 when spring 37 is relaxed, so that the upper clamp part 22 is held in its raised position.

Magnet 4 is energized to bring arm 2 from its inoperative position into the sewing position so that arm 2 executes a pivotal movement about pin 3. The upper clamp part 22 moves in a downward direction synchronously with arm 2, pivoting about the axis 25. Because spring 37 has a flatter characteristic than spring 45, as soon as frame 26 rests on the work, arm 2 is displaced relative to guide rod 30, and pressure roller 29, contacting on pressure bar 28 and spring 37, is compressed. Guide rod 30 moves upwardly in the cast-on part 31 until the pin 35 which secures it against rotation has reached the upper region of slot 36. Arm 2 and upper clamp part 22 now form a rigid unit, so that, during the further descending movement of arm 2, spring 45 is compressed until arm 2 has reached its sewing position fixed by the end position of magnet 4.

During the pivotal movement of arm 2, the lower clamp part 23 is pivoted about pin 42 by a corresponding amount. However, since pin 42 is relatively far from the stitch formation point, the amount of pivotal movement is relatively small, so that after the pivotal movement, part 23 still occupies an almost horizontal position. After arm 2 is fixed in its sewing position, the mutual correlation of needle 10 or, respectively, the needle stroke and the looper 12, is assured. Lower clamp part 23 is thereby pressed downward in an amount according to the thickness of the work. The variation in work thickness is thus compensated by the position in height of the lower clamp part 23, so that the distance of the top side of the work from looper 12 or from the eye of the needle remains constant, assuming a specific needle position. Accordingly, the length of the needle thread loop forming between the eye of the needle and the top side of the work also remains constant, regardless of the work thickness. For the stitch formation, this provides invariable conditions completely independent of the work thickness which results in perfect stitching.

To form the buttonhole seam, the needle 10, passing through the work from below, and looper 12, are driven through the driving means as shown. The pressure roller 29 rolls on the pressure bar 28 so that the tensioning pressure supplied by the compressed spring 45 prevails between the upper and lower clamp parts 22 and 23.

An intermittant rotary movement is transmitted by the two eccentrics 48 and 49 of the stepping mechanism 47 via the belt tool 50 and the toothed belt 51 to the belt wheel 53 firmly connected with the threaded nut 54. The non-rotationally mounted spindle 55 shifts in the direction corresponding to the direction of rotation of nut 54 and moves the intermediate plate 40 connected with it parallel to its axis, with clamp 21 being moved in a manner not shown in a longitudinal direction of the tensioning frame 26.

During stitch formation, the looper thread runs from its exit opening in the bobbin capsule 58 over the thread deflector 64 of guide member 61 to the last puncture hole in the work. At this point, the looper thread is deflected downwardly almost vertically by thread deflector 64. The loop of the needle thread, seized by looper tip 57 and guided around bobbin capsule 58, slips around the thread-stopping lug 59 and slides downwardly along the almost vertical portion of the looper thread. Due to this, insignificantly different stitch forming conditions result in the two feed directions of the tensioning frame 26 and the mutual looping of the looper thread and needle thread is approximately constant in both directions of feed.

When sewing thin soft fabrics, there is a danger that because of the relatively large cutout 27 in frame 26, with the thread insertion and the pulling through of the needle thread, the work does not remain flat on the cover plate 38 while the needle thread is being passed around the capsule 58, but executes a lift movement with every stitch formation. These movements, usually termed "flapping", lead to inferior seam formation because of irregular thread looping, in particular, due to the fact that the successive needle insertions are at different distances from the lateral bearing parts **26*a* of frame 26 and that, if the work is elastic, these scattered insertion zones are lifted off of the bearing plane in varying degrees. With the fabric hold-down member 65 extending to directly above the work surface, such flapping of the work during the sewing operation is avoided to a large extent. At the same time, the danger that stitches are omitted because of insufficient development of the needle thread loops, due to the flapping of the work, which are then not seized by looper tip 57**, is also eliminated.

At the end of the sewing operation, the sewing machine is stopped with the needle 10 in the low position, and arm 2 is brought from the sewing position to the inoperative position by the electromagnet 4 to be energized again. As arm 2 moves upwardly, first spring 45, which supplies the tensioning pressure between the upper and lower clamp parts 22 and 23, relaxes, owing to which, clamp 21 executes a pivotal movement about pin 42 and the lower clamp part 23 is brought from its sewing position to the charging point lying somewhat above the horizontal. After spring 45 is relaxed, with the further pivotal movement of arm 2, spring 37 relaxes. With arm 2 continuing to move upwardly, the upper clamp part 22 remains on the work until pin 35 of the guide rod 30 is in the region of the lower end of the slot 36 in the cast-on part 31. Not until the end of this relative movement between arm 2 and upper clamp part 22, which is reached by the idle stroke of the drive connection between arm 2 and clamp 21, does the guide rod 30 present in its lower position take along the upper clamp part 22 upwardly via the tappet 32 which engages the pressure bar 28 from below. Arm 2 continues its pivotal movement about pin 3 until its inoperative position is reached. At this point, upper clamp part 22 executes a pivotal movement about axis 25 and is held in the inoperative position of arm 2 by the tappet 32 engaging the pressure bar 28 from below.

Due to the idle stroke in the drive connection between arm 2 and upper clamp part 22, part 22, although moved along by the arm moving into its inoperative position, is lifted off of the lower clamp part 23 by only a small amount. This amount is chosen so that it does not hinder the insertion and removal of the work and still permits easy alignment of the work by the tensioning frame 26 present just above the lower clamp part 23, or by the cutout 27 thereof.

While a specific embodiment of the invention has been shown and described in detail to illustrate the application of the principles of the invention, it will be understood that the invention may be embodied otherwise without departing from such principles.

What is claimed is:

1. A sewing machine for sewing workpieces with a needle which reciprocates in a needle operational plane and penetrates the workpieces in an area of stitch formation, comprising a stationary bottom part, an arm having one end pivotally mounted on said bottom part and an opposite arm end overlying said bottom part, said arm being movable from a fixable sewing position to an inoperative position away from the area of stitch formation, a revolving looper having an axis about which it is rotatable and being rotatably mounted on said opposite arm end and having a thread exit opening, said needle being mounted for upward and downward movement on said bottom part for cooperation with said looper, means on said bottom part for clamping a workpiece between said needle and said looper at the area of stitch formation, said needle traversing the workpiece upwardly to effect the stitch formation, a looper thread guide member mounted on said opposite arm end adjacent said looper having a thread deflector located between the needle and said thread exit opening of said looper and extending above the area of stitch formation directly laterally of the needle operational plane and crosswise to said axis of said looper, said deflector including a downwardly extending work hold-down member directed downwardly from the thread deflector and wherein said means for clamping a workpiece comprises a lower clamping part overlying said bottom part and an upper clamp part pivoted to said bottom part and having a front arm portion with a tensioning frame forming an opening through which the needle passes, said hold-down member protruding through said tensioning frame to directly above said tensioning frame on the work.

2. A sewing machine according to claim 1, wherein said looper includes a stopper attached to said opposite arm end, and said guide member comprises a stopping element.

* * * * *